US006318051B1

(12) United States Patent
Preiss

(10) Patent No.: US 6,318,051 B1
(45) Date of Patent: Nov. 20, 2001

(54) METHOD AND DEVICE FOR AUTOMATIC DISPATCHING OF SINGULAR ITEMS, SPECIALLY AN INDIVIDUAL PILL

(75) Inventor: Manfred Preiss, Nürnberg (DE)

(73) Assignee: P+P Materialfluss-Systeme GmbH (DE)

( * ) Notice: Subject to any disclaimer, the term of this patent is extended or adjusted under 35 U.S.C. 154(b) by 0 days.

(21) Appl. No.: 09/341,062

(22) PCT Filed: Dec. 30, 1996

(86) PCT No.: PCT/DE96/02473

§ 371 Date: Jun. 29, 1999

§ 102(e) Date: Jun. 29, 1999

(87) PCT Pub. No.: WO98/29084

PCT Pub. Date: Jul. 9, 1998

(51) Int. Cl.[7] ..... B65B 57/00

(52) U.S. Cl. ..... 53/493; 53/492; 53/55; 53/509; 53/237

(58) Field of Search ..... 53/474, 471, 472, 53/435, 492, 55, 493, 509, 154, 156, 237, 240, 256; 221/13, 25, 9, 93, 94, 95, 2, 7, 26, 32; 700/242, 243, 244, 237, 232; 368/10, 11

(56) References Cited

U.S. PATENT DOCUMENTS

| | | | | |
|---|---|---|---|---|
| 4,542,808 | * | 9/1985 | Lloyd, Jr. et al. | 221/2 |
| 4,812,629 | * | 3/1989 | Oneil et al. | 235/383 |
| 5,038,968 | * | 8/1991 | Albetski | 221/1 |
| 5,368,187 | * | 11/1994 | Poncetta et al. | 221/30 |
| 5,499,707 | * | 3/1996 | Steury | 221/2 |
| 5,647,505 | * | 7/1997 | Scott | 221/2 |
| 5,832,693 | * | 11/1998 | Yuyama et al. | 53/168 |
| 5,943,841 | * | 8/1999 | Wunscher | 53/154 |
| 5,946,883 | * | 9/1999 | Yuyama et al. | 53/154 |
| 6,098,795 | * | 8/2000 | Mollstam et al. | 206/222 |
| 6,175,779 | * | 1/2001 | Barrett | 700/242 |

FOREIGN PATENT DOCUMENTS

| | | | | |
|---|---|---|---|---|
| 9416212 U | * | 2/1995 | (DE) | 53/154 |

* cited by examiner

*Primary Examiner*—Peter Vo
*Assistant Examiner*—John Paradiso
(74) *Attorney, Agent, or Firm*—McGlew and Tuttle, P.C.

(57) ABSTRACT

In a process and a device for automatically commissioning singular individually packaged products (1), especially a single pill, from a supply station (2) with a plurality of containers, prepackaged, preselected, flat, individually packaged product packs ("blister packs") of the same type are arranged in stacks in assigned containers in the form of essentially vertical storage shafts (3). A blister pack (4) of a singular individually packaged product (1) to be commissioned is displaced into a lateral dispensing position (E) located outside the stack, and a receiving tray (5) is positioned under it. A dispensing unit (6) assigned to the storage shafts (3) with a dispensing finger (7) is then positioned above the individually packaged product (1) to be commissioned, which is in the dispensing position (E), and the dispensing finger (7) is moved downward toward an abutment (8) to separate the singular individually packaged product from the rest of the blister pack. The separated individually packaged product falls under its own weight into a predetermined recess (9) of the receiving tray (5). The individually packaged product (1) to be commissioned is separated by pushing the individually packaged products out of the pack by means of a pushing plunger or by cutting out the individually packaged product by means of a cutting knife.

39 Claims, 7 Drawing Sheets

Fig. 7
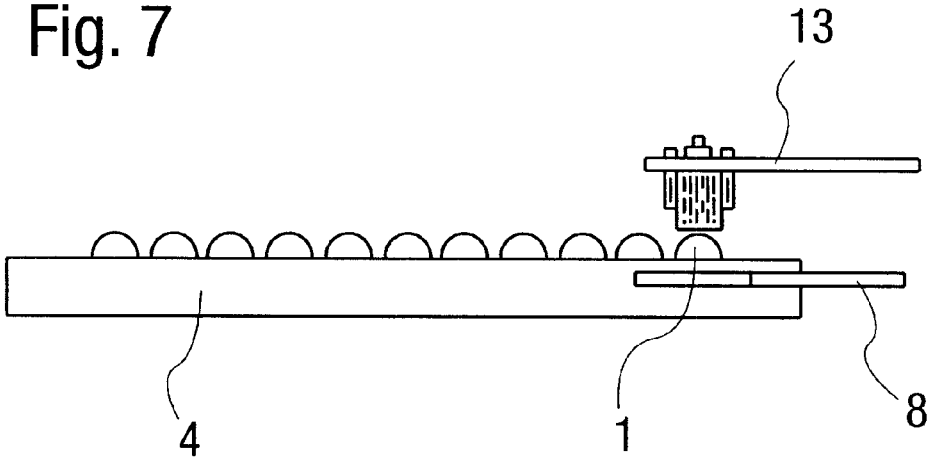
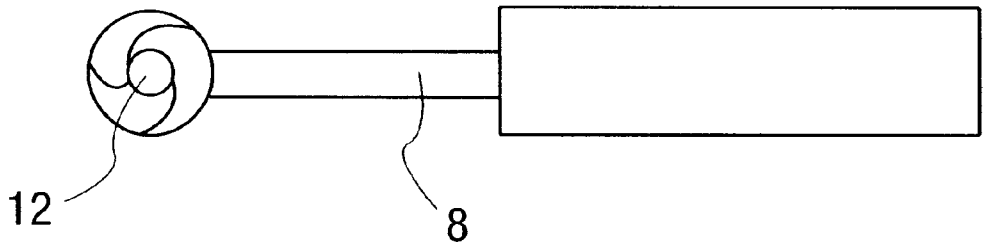
Fig. 8

METHOD AND DEVICE FOR AUTOMATIC DISPATCHING OF SINGULAR ITEMS, SPECIALLY AN INDIVIDUAL PILL

FIELD OF THE INVENTION

The present invention pertains to a process and a device for automatically commissioning singular individually packaged products, especially a single pill, from a supply station with a plurality of containers.

BACKGROUND OF THE INVENTION

In hospitals, drug doses are sorted in individual departments by the health care personnel for patients of that department in trays with recesses according to the time of day at which they are to be taken; morning, noon, evening or night. The health care personnel has to spend about 2 hours per day and department doing this, and it also requires a drug storage facility in each department, at least for a limited amount and variety of drugs, which leads to expensive stocking and the risk of expiration of the expiration date. Since stocking must be taken into account in each department, a correspondingly large inventory of drugs must also be kept in the hospital pharmacy or the supply pharmacy of the hospital. Packages for the department stockrooms are commissioned for the individual departments once or even twice a day.

An automatic commissioning device for drugs (U.S. company of BAXTER), which has individual plastic containers for drugs, has been known. The containers contain one type of drug as an open, i.e., unpackaged bulk product, which must be confirmed in writing by at least two pharmacists. Each container has a wheel-shaped dispensing device with an electric motor-driven ejector, which is set by the manufacturer to the product to be commissioned and is put into operation when the individually packaged products are commissioned and delivers a single pill into the feed hopper, through which the pill will then slide into a plastic bag assigned to the patient.

The drawback is the expensive checking, the complicated setting of the device, as well as the complicated design, so that only relatively few types of drugs and only frequently requested drugs can be stored and commissioned automatically. The use of such an automatic unit is limited to 900 to 1,500 specialties in an assortment used in hospitals.

It should also be taken into account and is disadvantageous that only open, unpackaged individually packaged products can be commissioned, i.e., open pills, capsules, tablets, which are filled or strewn into the corresponding compartments of the automatic unit. Thus, only about 200 unpackaged drug types are available in a hospital. The prepackaged drug types are unsuitable for the automatic hygienic commissioning process from the very beginning and must be "commissioned" by the health care personnel by hand.

Open unpackaged pills, etc., are also subject to a certain wear or mutual abrasion during commissioning. As a result, the single dose to be administered cannot be exactly ascertained for a patient. Moreover, since only one feed hopper is provided for all plastic bags, cross contamination may sometimes happen, namely, when rests of one drug come into contact with another drug commissioned later in the feed hopper. Finally, the commissioned plastic bags must be further handled, labeled and distributed manually. The risk of mixup of the commissioned pills up to the patient is not ruled out.

SUMMARY AND OBJECTS OF THE INVENTION

Based on the above-described state of the art, the object of the present invention is to provide a commissioning process and a commissioning device of the type described in the introduction, which process and device make it possible with simple means to reliably and automatically commission even packaged, singular individually packaged products.

The basic object of the present invention is accomplished by a process of the type described in claim 1. The process according to the present invention is advantageously improved by the features of claims 2 through 15.

An automatic commissioning device operated according to the above-mentioned process is characterized by the features of claim 16. The automatic commissioning device is advantageously improved by the features of claims 17 through 35.

The essence of the process according to the present invention for the automatic commissioning of singular individually packaged products, especially a single pill, from a supply station with a plurality of containers is that preselected, flat, individually packaged product packs of the same type, so-called "blister packs," are stacked in assigned containers in the form of essentially vertical storage shafts; that a blister pack of singular individually packaged products to be commissioned is displaced into a lateral dispensing position located outside the stack; that a receiving tray is positioned under the individually packaged products, which are to be commissioned and are in the dispensing position; that a dispensing unit assigned to the storage shafts with a dispensing finger is positioned above the individually packaged products, which are to be commissioned and are in the dispensing position, and the dispensing finger is moved downward toward an abutment to separate the singular individually packaged products from the rest of the blister pack and the separated individually packaged products are received in a predetermined recess of the receiving tray.

Despite automation, the blister packs are preferably placed or stacked manually into the assigned storage shafts, because the blister packs are normally prepackaged and presorted by the manufacturer in large institutional packs. The original box containing the blister packs is then scanned and a code is permanently assigned to it at the assigned storage shaft. The storage shaft can now be opened. The agreement of the code is compared each time product is introduced.

At the same time, an assigned article number and an assigned blister arrangement (location of the drugs) are written in a transponder of the storage shaft by means of a writing-reading unit located at the dispensing unit.

For commissioning, the lowermost blister pack of individually packaged products to be commissioned is preferably displaced by a displacing unit into the dispensing position.

A coded receiving tray, especially a patient tray, is fed to the dispensing unit, and a commission given on the consumer or patient code is transmitted to an electronic control device, especially as aisle master computer. The data contain both the name of the article and the quantity as well as the time at which the pill is to be taken.

The electronic control device has both a control function for the individual assembly units and checking functions for the correct selection or commissioning of all desired singular individually packaged products in a receiving tray.

The dispensing unit is moved by means of the electronic control device into a (first) dispensing position of the storage shaft reached, and the transporter is read. It ascertains that the correct storage shaft has been reached and contains the position within the blister at which the next dispensing will take place.

Then (or already before), the receiving or patient tray is positioned under the above-mentioned dispensing position, i.e., under the individually packaged products to be commissioned in the dispensing position.

An abutment in the form of an iris is moved to the dispensing position under the blister and is set to the size of the individually packaged products.

A pushing plunger, whose size and shape are adjustable, or a cutting knife is positioned above the individually packaged products to be commissioned, and the individually packaged products are pushed or cut off into the recess of the receiving tray without direct contact.

Should individually packaged products, especially a drug, from another plane be needed, the receiving tray is transferred by means of an elevator into the desired other storage shaft plane in the case of storage shafts which are arranged one on top of another and are to be commissioned one after the other. This process can be minimized by storing drugs typical of the given department in the same storage shaft plane.

The receiving tray supplied with commissioned individually packaged products is moved by means of the dispensing unit to a transfer station and is transferred to the transfer station.

Finally, the receiving tray is covered and printed on at the transfer station and is delivered to the corresponding hospital department to the area of the end user, especially a patient, preferably by means of a closable carriage.

A device for automatically commissioning singular individually packaged products, especially a single pill, with a storage station with containers containing different types of individually packaged products, is characterized in that the containers are designed as essentially vertical storage shafts, with which preselected, flat, individually packaged product packs ("blister packs") are assigned, and the latter are arranged in the form of a stack in the assigned storage shafts, wherein at least one displacing unit is provided, by which a blister pack of singular individually packaged products to be commissioned can be displaced into a lateral dispensing position located outside the stack; that a support is provided, on which a receiving tray can be positioned in the dispensing position under individually packaged products to be commissioned; and that a dispensing unit assigned to the storage shafts is provided with at least one dispensing finger, which can be positioned above the individually packaged products to be commissioned and are located in the dispensing position, and it can be moved toward an abutment to separate the singular individually packaged products from the rest of the blister pack.

The support may be a movable receiving tray feed unit or the dispensing unit itself, by which a receiving tray having a plurality of recesses can be positioned under the individually packaged products to be commissioned, which are in the dispensing position, and a separated individually packaged product is received in a predetermined recess in the position assumed.

In one variant of the embodiment, the dispensing finger comprises an essentially vertically movable pushing plunger, which pushes the individually packaged products to be commissioned out of the package with the blister pack being torn open locally in the push-through area.

The pushing plunger may be an adaptive plunger, which comprises a bundle of needles that are displaceable in relation to one another and can be fixed during operation.

The abutment advantageously comprises an adjustable bearing eye or an adjustable iris, which can be adjusted to the circumferential contour of the individually packaged products to be pushed through, such that there is no contact during the pushing through of the individually packaged products.

In an alternative embodiment, the dispensing finger may have, instead of the pushing plunger, a cutting knife, which cuts off the individually packaged product to be commissioned together with the packaging area immediately surrounding it from the rest of the blister pack and ejects it, packed singularly and hygienically, into a corresponding position in the receiving tray ready to receive it.

The cutting knife advantageously has two blades arranged at an angle to one another, which preferably form an angle of 90°.

The cutting knife has at least one oblique cutting edge for effective cutting.

The cutting knife is pivotably articulated especially to an essentially horizontal axis of the dispensing finger.

The storage shafts may be arranged in a circular form around a central, rotatable dispensing unit, wherein a selected storage shaft can be reached.

In another variant, the storage shafts may be arranged in a straight line, in which case the dispensing unit is displaceable or movable along the row of storage shafts and a selected storage shaft can be reached.

In expanding the above-mentioned variant, two straight rows of storage shafts located at spaced locations and opposite from one another may be provided, in which case the dispensing unit can be displaced or moved between the two rows of storage shafts.

The dispensing unit is preferably guided by a rail or bar and is driven by means of a toothed belt by a drive motor arranged at one end of one row of storage shafts.

Furthermore, a receiving tray transfer station, which can be controlled by the dispensing unit and may be arranged at the other end of the row of storage shafts facing away from the drive motor, may be provided.

In expansion of the arrangement of storage shafts in a row or circle, at least two rows or rings of storage shafts arranged one on top of another may be provided.

Rows or rings of storage shafts arranged one on top of another may be connected to one another by a receiving tray elevator.

It is especially advantageous for a plurality of adjacent storage shafts to form a composite, one-piece storage module and for a row of storage shafts or a ring of storage shafts to be composed of a plurality of storage modules.

The transfer station may have a packaging means for hygienically packaging a receiving tray filled with selected individually packaged products, in which case the individually packaged products, which are sorted in the recesses of the receiving tray, can be covered and labeled and held in the recesses up to the end user until the cover film is torn open.

Consequently, the present invention provides a commissioning process and a commissioning device, whereby commissioning into a patient tray can be performed, in particular, already in a hospital pharmacy or supply pharmacy. The drug can be placed from the original blister pack into one of about 20 nests or recesses of the patient tray without an intermediate step, so that a subsequent removal of a certain dose is possible. The drug is commissioned reliably, rapidly and unambiguously. It can be unambiguously identified after commissioning and can be unmistakably assigned to the patient. Cross contamination by molecules of different drugs is ruled out.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIG. 7 shows a schematic side view of a push-through area of the automatic commissioning device with blister pack, dispensing finger and abutment, FIG. 8 shows a schematic top view of the abutment according to FIG. 7 with adjustable iris.

DESCRIPTION OF THE PREFERRED EMBODIMENTS

Figure 1:
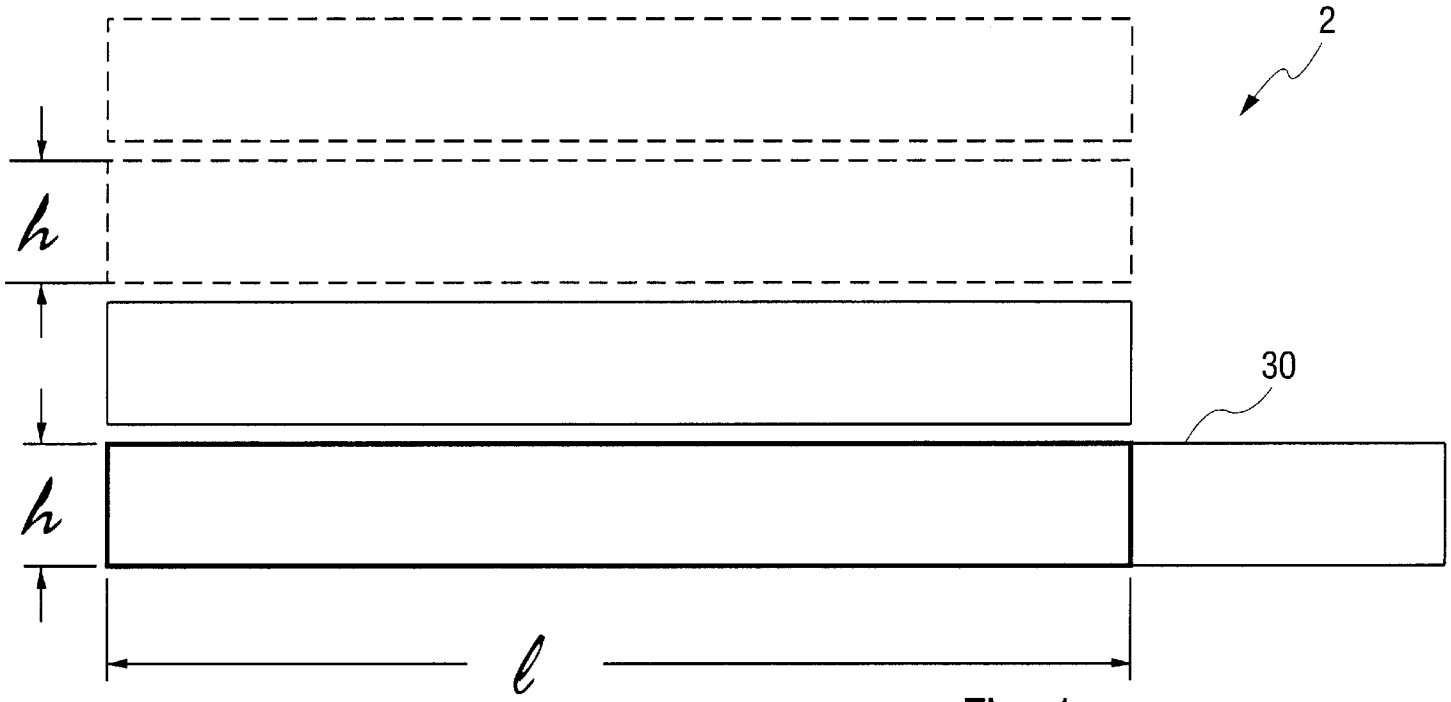
FIG. 1 shows a schematic side view of an automatic commissioning device operated according to a process according to the present invention in series arrangement.

The device for automatically commissioning singular individually packaged products, especially a single pill, which is shown in the drawings, comprises a supply station 2 with a plurality of containers in the form of vertical storage shafts 3, in which preselected, flat planar packs of individually packaged products, so-called blister packs 4, are stacked.

Figure 10:
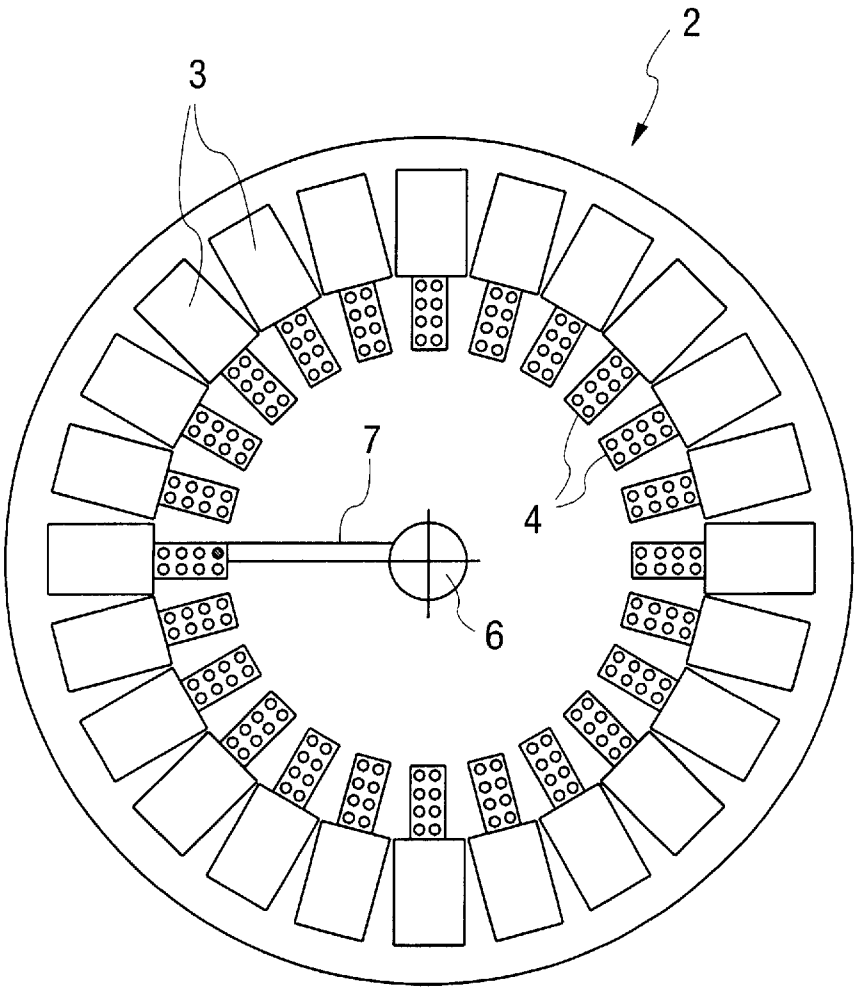
FIG. 10 shows a schematic top view of the automatic commissioning device according to FIG. 9.
Figure 9:
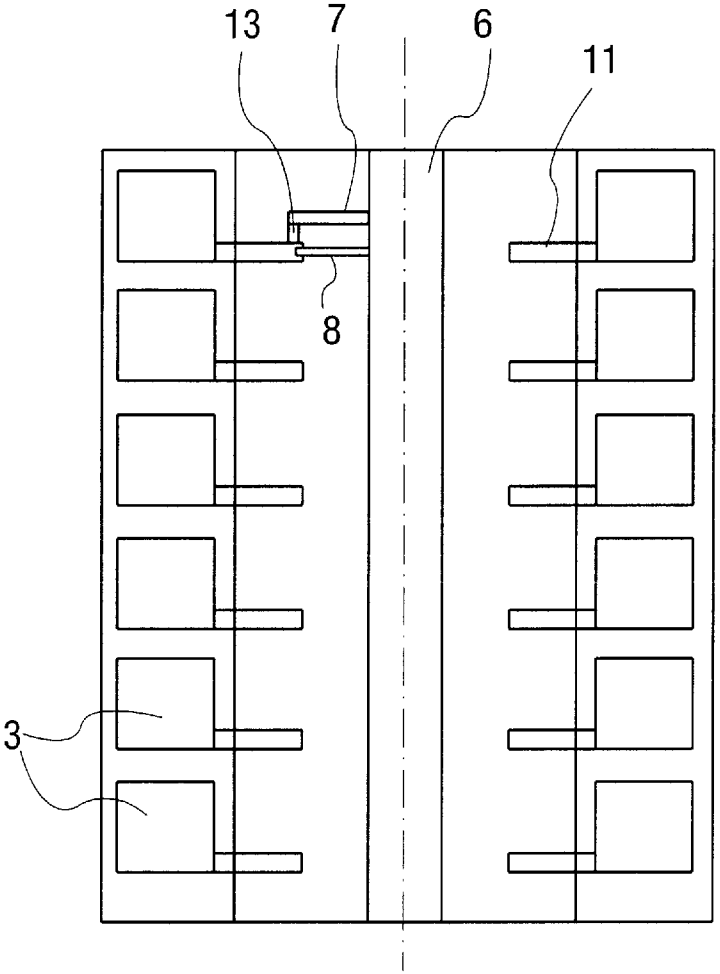
FIG. 9 shows a schematic vertical section of another automatic commissioning device with storage shafts arranged one on top of another in a circular arrangement.

The storage shafts 3 may be arranged in a circular pattern according to FIGS. 9 and 10 or in a plurality of vertical planes.

Figure 2:
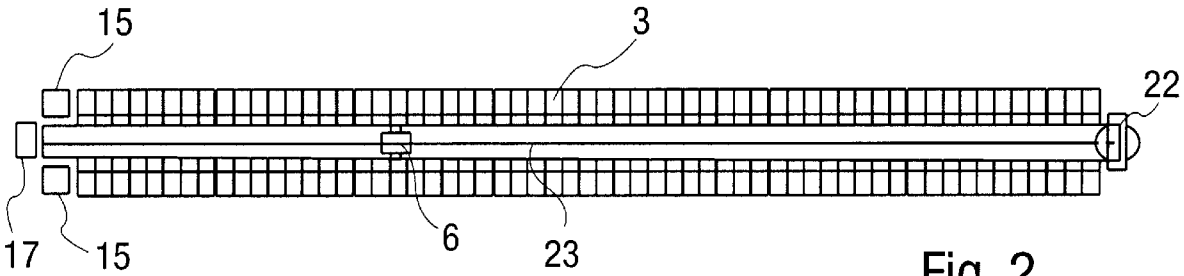
FIG. 2 shows a schematic top view of the automatic commissioning device according to FIG. 1.

The storage shafts 3 may be arranged individually or in a modular design alternatively also in a straight row or in two straight rows located opposite each other according to FIGS. 1 and 2, especially also in one or more vertical planes, and horizontal expansions 30 are also conceivable.

A displaceable or movable dispensing unit, which is guided by a rail or bars 35, is driven by a drive motor 22 and a toothed belt 23 and can service a selected storage shaft 3 as well as a transfer station 17, as will be described below, is located between two opposite rows of storage shafts. Different vertical storage shaft planes are connected by elevators 15.

Figure 3:
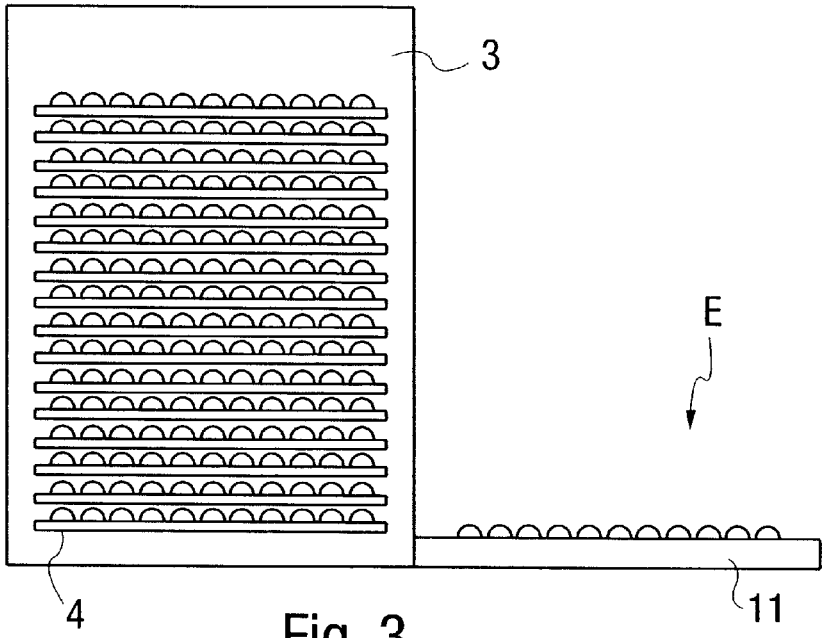
FIG. 3 shows a schematic front view of a row of storage shafts of the automatic commissioning device with a blister pack in a dispensing position.
Figure 4:
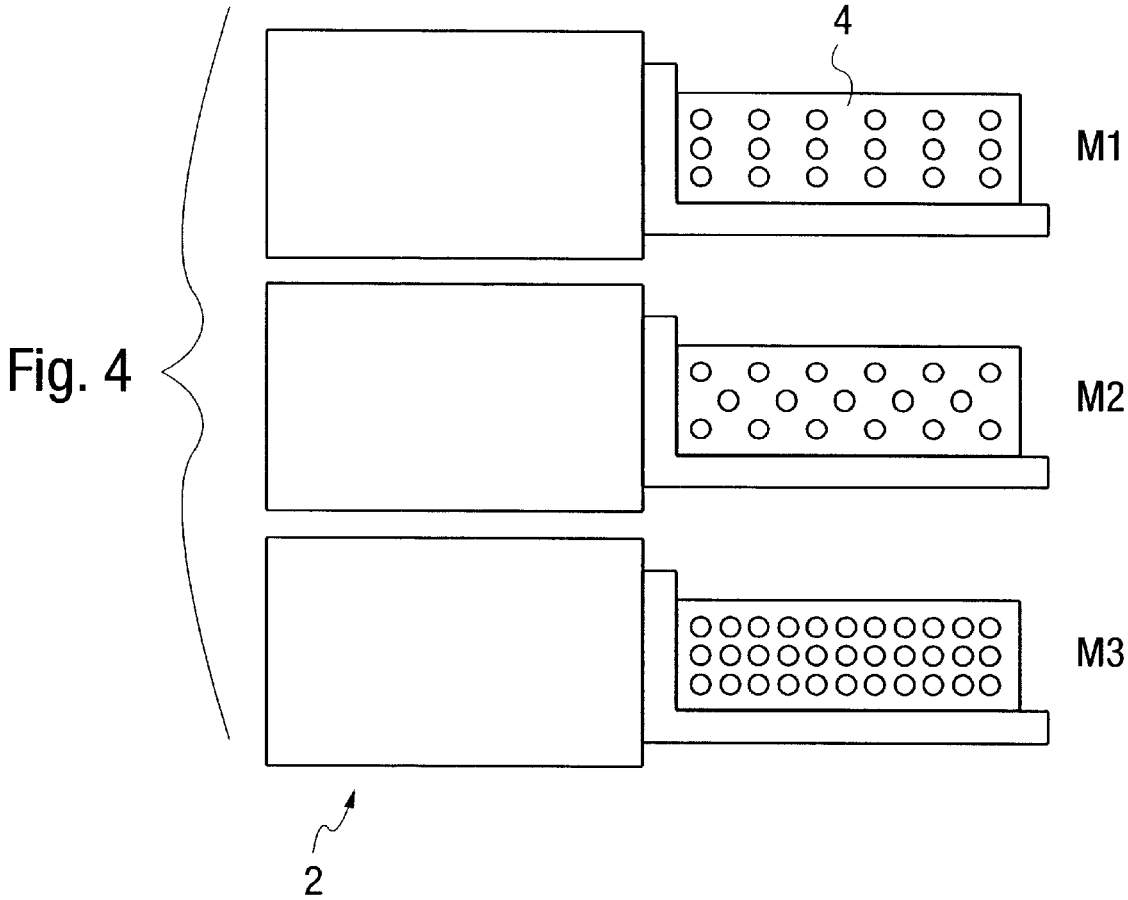
FIG. 4 shows a schematic top view of a row of storage shafts with different blister packs in dispensing positions.

A certain type of identical blister pack 4 with a blister pattern M1, M2 or M3 is stored in each storage shaft 3, as is shown especially in FIGS. 3 and 4.

Besides the storage shafts 3, the commissioning device has at least one displacing unit 11, by which a lowermost blister pack 4 in the stack of a singular individually packaged product 1 to be commissioned can be displaced into a lateral dispensing position E located outside the stack; a support 18, on which a receiving tray 5 can be positioned in a dispensing position E under an individually packaged product 1 to be commissioned; and the above-mentioned dispensing unit 6 assigned to the storage shafts 3 with at least one dispensing finger 7, which can be positioned above the individually packaged product to be commissioned, which is in the dispensing position, and can be moved downward toward an abutment 8 to separate the singular individually packaged product from the rest of the blister pack.

The support 11 may be a movable receiving tray feed unit or, according to the drawing, part of the dispensing unit 11 itself, by which a receiving tray 5 having a plurality of recesses can be positioned under the individually packaged product to be commissioned, which is in the dispensing position, and a separated individually packaged product falls under its own weight in the position assumed into a predetermined recess of the receiving tray.

In one variant of the embodiment according to FIGS. 1 through 10, the dispensing finger 7 comprises an essentially vertically movable pushing plunger 13, which pushes the individually packaged product 1 to be commissioned out of the packaging with the blister pack being torn open locally in the push-through area.

The pushing plunger is, in particular, an adapted plunger according to FIG. 7, which comprises a bundle of needles that are displaceable in relation to one another and can be fixed during the operation.

The abutment 8 comprises an adjustable bearing eye 12 or an adjustable iris, which can be adjusted to the circular contour of the individually packaged products to be pushed through, such that there is no contact during the pushing through of the individually packaged products.

Figure 11:
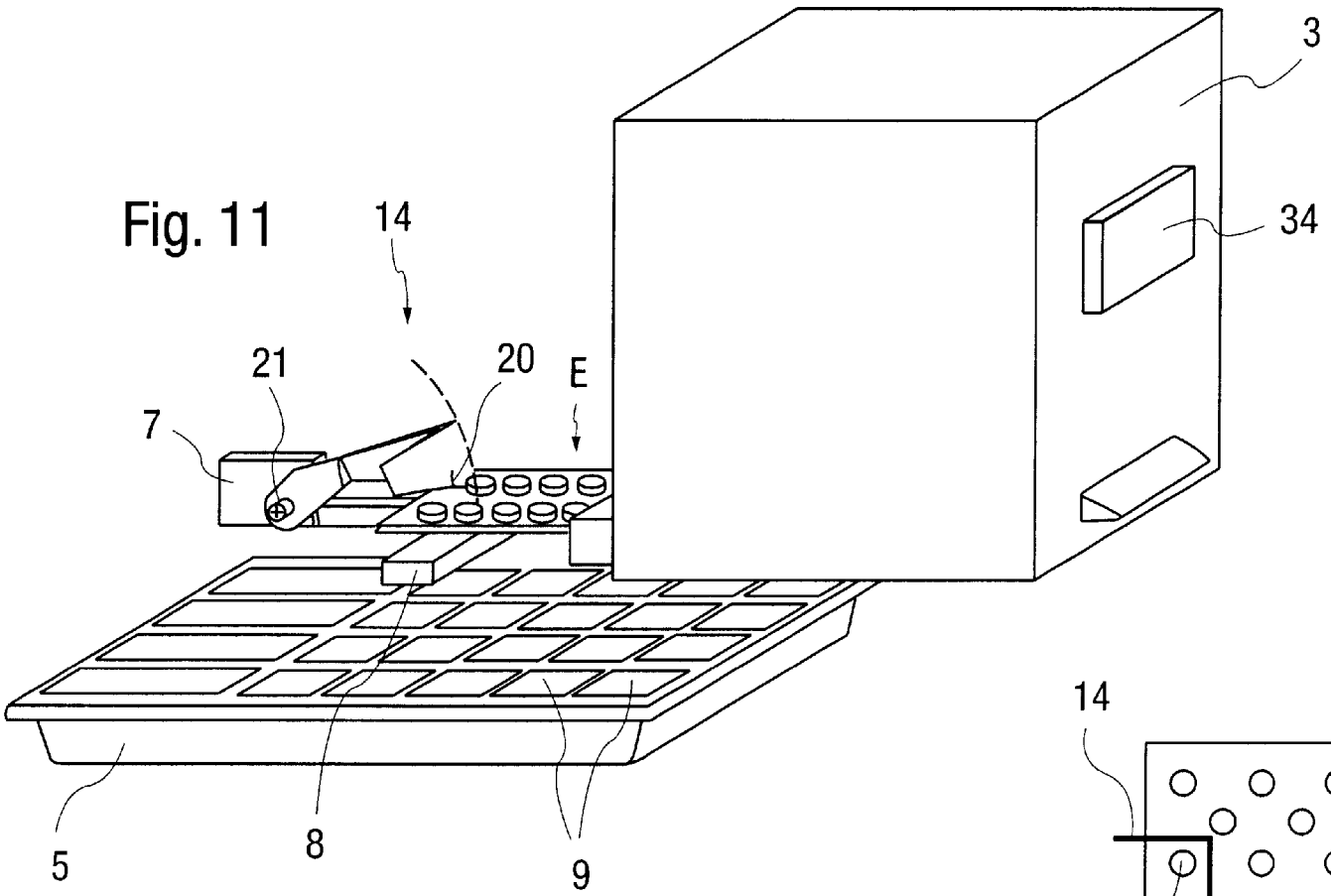
FIG. 11 shows a perspective view of a storage shaft with another dispensing fingers and receiving tray.
Figure 12:
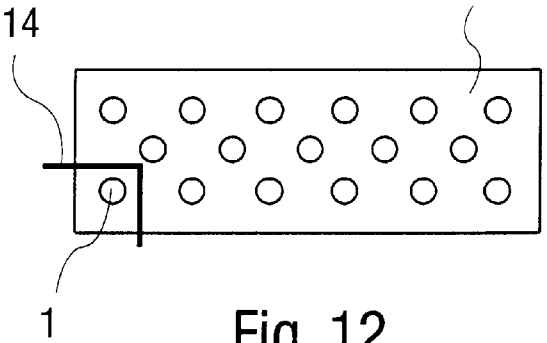
FIG. 12 shows a schematic top view of a blister pack according to FIG. 11 with a cutting knife.

In an alternative embodiment, the dispensing finger 7 according to FIGS. 11 and 12 may have, instead of the pushing plunger 13, a cutting knife 14, which cuts off the individually packaged product 1 to be commissioned together with the packaging area immediately surrounding it from the rest of the blister pack and ejects it, packaged singularly and hygienically, into a corresponding position in the receiving tray 5 ready to receive it.

The cutting knife 14 has two blades arranged at an angle to one another, which have an angle of 90°, and an oblique cutting edge 20 for effective cutting.

The cutting knife 14 is pivotably articulated to an essentially horizontal axis 21 of the dispensing finger 7.

During the operation of the device, the blister packs 4 are placed or stacked manually into the assigned storage shafts 3 by a human operator. The original box containing the blister packs is then scanned and permanently assigned to a code 34 at the assigned storage shaft 3. The storage shaft can now be opened. The agreement of the code is compared each time product is introduced.

At the same time, an assigned article number and an assigned blister arrangement (location of the drugs) are written in a transponder 10 of the storage shaft by means of a writing-reading unit located at the dispensing unit 6.

For commissioning, the lowermost blister pack 4 of an individually packaged product 1 to be commissioned is displaced by the displacing unit 11 into a dispensing position E.

The coded receiving tray 5, especially a patient tray, is fed to the dispensing unit 6, and a commission indicated on the user or patient code is transmitted to an electronic control device, especially an aisle master computer. The data contain both the name of the article and the quantity as well as the time at which the drug is to be taken.

The electronic control device has both a control function for the individual assembly units and a checking function for the correct selection or commissioning of all desired singular individually packaged products in the receiving tray.

The dispensing unit is moved into the dispensing position E of the storage shaft 3 reached by means of the electronic control device, and the transponder 10 is read. It ascertains that the correct storage shaft 3 has been reached and it contains the position within the blister at which the next dispensing will take place.

Then (or already before), the receiving or patient tray is positioned under the above-mentioned dispensing position, i.e., under the individually packaged product to be commissioned in the dispensing position E.

Under the blister, the abutment 8 in the form of an iris is moved to the dispensing position and is set to the size of the individually packaged product.

The pushing plunger 13, whose size and shape can be adjusted to the individually packaged product 1 to be commissioned, or the cutting knife 14 is positioned above the individually packaged product 1 to be commissioned, and the individually packaged product is pushed or cut off into the recess of the receiving tray without direct contact.

Should an individually packaged product, especially a drug, from another level be needed, the receiving tray 5 is transferred by means of the elevator 15 into the desired other storage shaft plane in the case of storage shafts that are arranged one on top of another and are to be commissioned one after the other.

The receiving tray 5 provided with the commissioned individually packaged product 1 is moved by means of the dispensing unit 6 to the transfer station 17 and is transferred to this transfer station.

Finally, the receiving tray 5 is covered and printed on at the transfer station and is brought into the corresponding hospital department into the area of the end user, especially a patient, preferably by means of a closable carriage.

Figure 5:
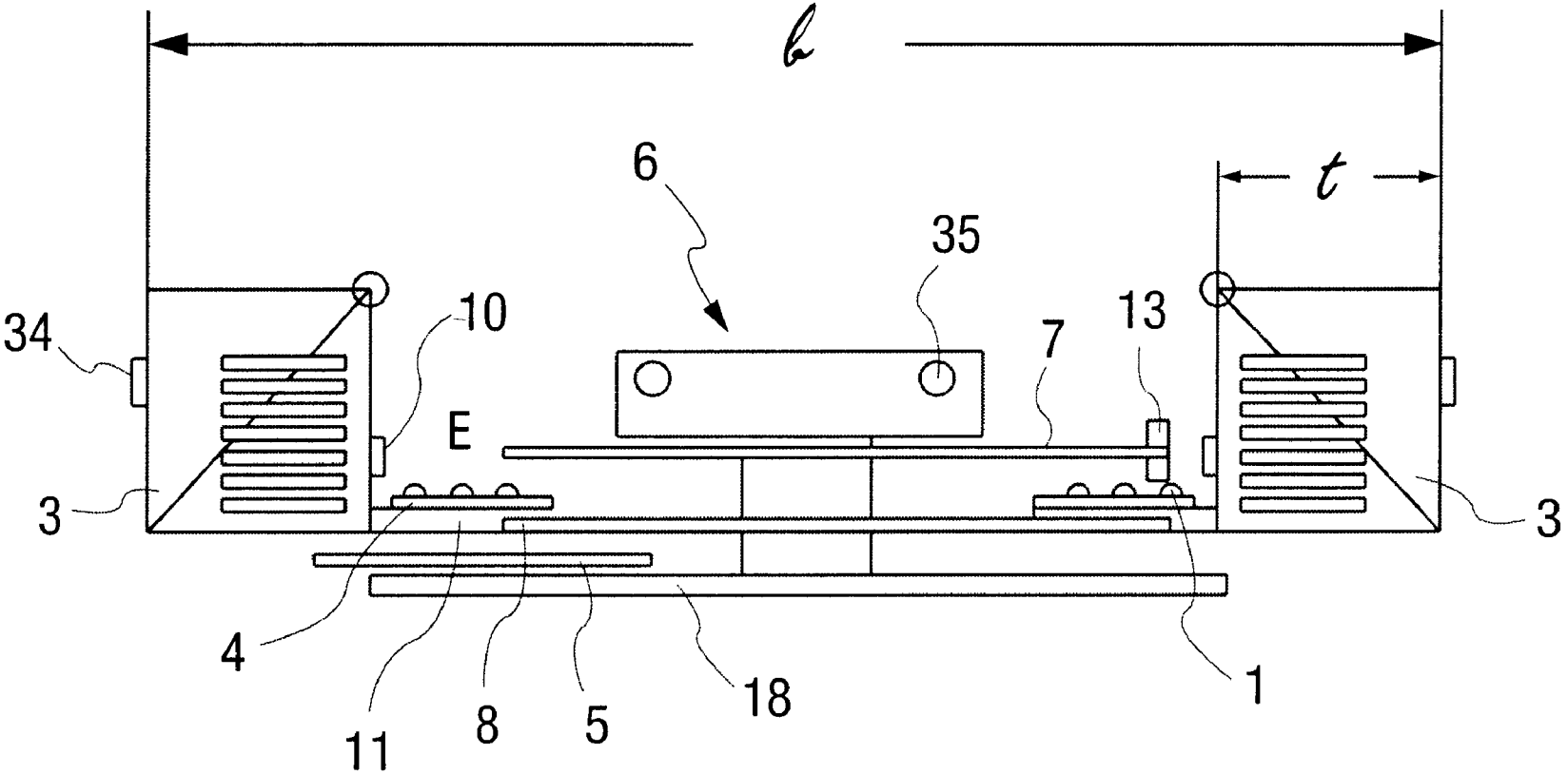
FIG. 5 shows a schematic sectional view of a dispensing unit of the automatic commissioning device.
Figure 6:
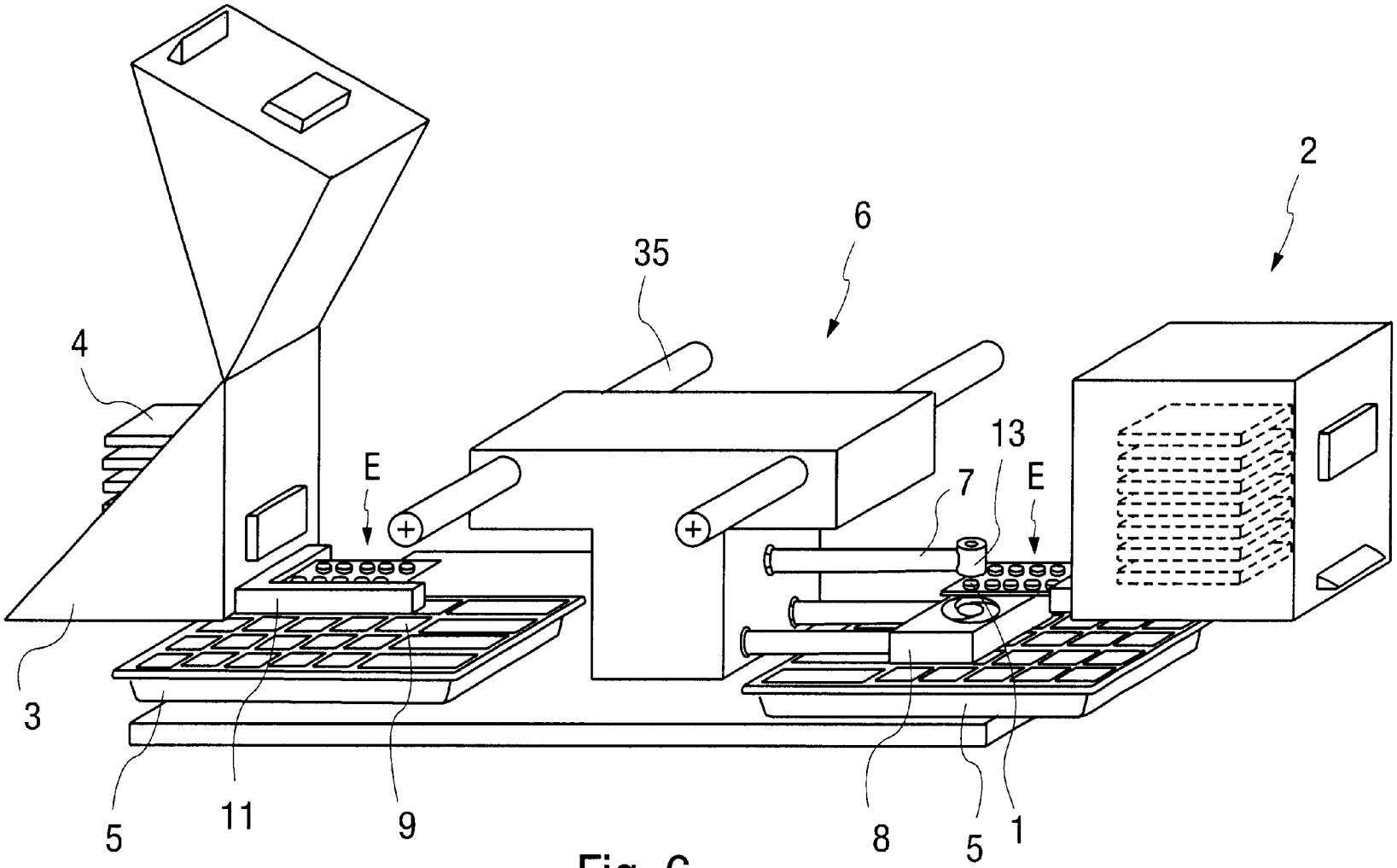
FIG. 6 shows a schematic perspective view of the dispensing unit according to FIG. 5.

In the modular design of individual storage shafts 3, it is possible to set up automatic commissioning devices of different sizes in a simple manner, e.g., according to FIG. 1, a length 1 of a row of storage shafts of about 5 m (5 modules) with an expansion 30 of about 2 m (2 modules), at an individual height h of about 40 cm and an individual depth t of about 25 cm of a storage shaft and an overall width b of about 1 m in the case of two rows of storage shafts located opposite each other according to FIGS. 2 and 5.

It shall also be noted that independently patentable features contained in the subclaims shall have a corresponding independent protection despite the formal reference made to the principal claim. All the inventive features contained in all the application documents also fall within the scope of protection of the present invention.

While specific embodiments of the invention have been shown and described in detail to illustrate the application of the principles of the invention, it will be understood that the invention may be embodied otherwise without departing from such principles.

What is claimed is:

1. A process for dispensing products, the process comprising:

providing a plurality of storage shafts;

loading each of said plurality of storage shafts with a plurality of substantially planar packs, each of the packs including a plurality of individually packaged products, said loading including arranging said plurality of packs substantially parallel to each other in said storage shafts;

displacing one of the plurality of packs out of one of said plurality of storage stacks into a lateral dispensing position, the one pack being displaced in a plane substantially parallel to the packs loaded in said one of said storage shafts;

positioning a dispensing unit with a dispensing finger adjacent to one side of the one pack in said lateral dispensing position;

positioning an abutment adjacent to another side of said one pack in said lateral dispensing position;

moving said dispensing finger toward one of the products of the one pack to remove the one product from the one pack;

positioning a receiving tray adjacent to said abutment at said lateral dispensing position to receive the one product.

2. A process in accordance with claim 1, wherein:

the plurality of packs are blister packs and the individually packaged products are pills;

said loading of the packs is performed by vertically stacking;

said positioning of said receiving tray is performed under the one pack in said lateral dispensing position;

said positioning of said dispensing unit is performed above the one pack in said lateral dispensing position;

said moving of said dispensing finger is downward and removes the one individually packaged product from a remainder of the blister pack.

3. A process in accordance with claim 2, wherein:

said displacing is performed on a lowermost said blister pack into said lateral dispensing position.

4. A process in accordance with claim 1, wherein:

said packs are one of stacked and placed manually into assigned said storage shafts.

5. A process in accordance with claim 4, wherein:

an original box containing said packs is identified and is permanently assigned to a code at a respective said assigned storage shaft.

6. A process in accordance with claim 5, further comprising:

comparing the code assigned to said storage shaft with a code on a new pack or new original box including new packs, each time the new pack or new box is loaded in said respective storage shaft.

7. A process in accordance with claim 1, further comprising:

providing a transponder on said storage shafts;

writing an assigned article number and an assigned blister arrangement in said transponder of said storage shaft with a writing-reading unit located at said dispensing unit.

8. A process in accordance with claim 7, further comprising:

reading said transponder when said dispensing unit and said receiving tray are moved into said dispensing position to identify said storage shaft and a position of the product to be dispensed from the pack.

9. A process in accordance with claim 8, wherein:

said receiving tray includes a plurality of recesses for receiving the products, said moving of said receiving tray is performed to position one of said recesses under the one product to be dispensed in said dispensing position, and to vertically align the one recess of said receiving tray with the one product.

10. A process in accordance with claim 9, wherein:

said dispensing finger has one of a pushing plunger with an adjustable size and shape, and a cutting knife, positionable above the one product to one of push and cut off the one product into said recess of said receiving tray without direct contact with the one product.

11. A process in accordance with claim 8, wherein:

said moving of said abutment is performed to positioned the abutment under the one product which is to be removed in said dispensing position, said abutment includes an iris and said iris is adjusted to a size of the one product.

12. A process in accordance with claim 1, further comprising:

coding said receiving tray with a code;

controlling said moving of said receiving tray, said moving of said dispensing unit and said moving of said dispensing finger by said code on said receiving tray.

13. A process in accordance with claim 12, wherein:

said controlling is performed by transmitting said code to an electronic control device.

14. A process in accordance with claim 1, further comprising:

arranging said storage shafts in a plurality of planes one on top of another;

transferring said receiving tray by an elevator between said planes of said storage shafts.

15. A process in accordance with claim 1, wherein:

said receiving tray is moved to a plurality of said storage shafts to receive a plurality of the products;

said receiving tray is moved to a transfer station by said dispensing unit and is transferred to the transfer station.

16. A process in accordance with claim 15, wherein:

said receiving tray is covered and printed on at said transfer station.

17. A process in accordance with claim 16, further comprising:

moving said receiving tray from said transfer station into an area of an end user by a closable carriage.

18. A device for dispensing products, the device comprising:

a plurality of storage shafts;

a plurality of substantially planar packs arranged adjacent and substantially parallel to each other in each of said storage shafts, each of said packs including a plurality of individually packaged products;

a displacing unit arranged with one of said storage stacks and displacing one of said plurality of packs out of said plurality of storage stacks into a lateral dispensing position, said one pack being displaced in a plane substantially parallel to said packs in said one of said storage shafts;

a dispensing unit movable among said plurality of storage shafts and movable adjacent to one side of the one pack in said lateral dispensing position, an abutment movable among said plurality of storage tanks and movable adjacent to another side of said one pack in said lateral dispensing position;

a dispensing finger movable on said dispensing unit toward one of the products of the one pack to remove the one product from the one pack;

a receiving tray movable among said storage shafts and movable adjacent to said abutment at said lateral removing position to receive the one product.

19. A device in accordance with claim 18, wherein:

the plurality of packs are blister packs and the individually packaged products are pills;

said packs are stacked vertically in said storage shafts;

a support is provided for positioning said receiving tray under the one pack in said lateral dispensing position;

said dispensing finger is positioned above the one pack in said lateral dispensing position and movable downward to remove the one individually packaged product from a remainder of the blister pack.

20. A device in accordance with claim 19, wherein:

said receiving tray defines a plurality of recesses;

said support is a movable feed unit or said dispensing unit itself, by which said plurality of said recesses of said receiving tray can be positioned under the one individually packaged product which is in said dispensing position, and a separated individually packaged product is received in a predetermined recess in an assumed position.

21. A device in accordance with claim 19, wherein:

said dispensing finger includes a vertically movable pushing plunger which pushes the one individually packaged product out of the pack with said blister pack being torn open locally in a push-through area.

22. A device in accordance with claim 21, wherein:

said pushing plunger is an adaptive plunger which comprises a bundle of needles that are displaceable in relation to one another and can be fixed during operation.

23. A device in accordance with claim 19, wherein:

said dispensing finger comprises a cutting knife which cuts off the one individually packaged product and packaging area immediately surrounding the one product from a remainder of the blister pack.

24. A device in accordance with claim 23, wherein:

said cutting knife has two blades arranged at an angle in relation to one another.

25. A device in accordance with claim 24, wherein:

said angle between said two blades is substantially 90°.

26. A device in accordance with claim 23, wherein:

said cutting knife has at least one oblique cutting edge.

27. A device in accordance with claim 23, wherein:

said cutting knife is pivotably articulated to a substantially horizontal axis of said dispensing finger.

28. A device in accordance with claim 18, wherein:

said abutment comprises an adjustable bearing eye or an adjustable iris, said bearing eye or said iris is adjustable to a circular contour of the one product.

29. A device in accordance with claim 18, wherein:

said storage shafts are arranged in a circular pattern around a central and rotatable said dispensing unit, wherein a selected one of said storage shafts can be reached by said dispensing unit.

30. A device in accordance with claim 18, wherein:

said storage shafts are arranged in a straight row and said dispensing unit can be displaced in parallel to said row of storage shafts to reach a selected one of said storage shafts.

31. A device in accordance with claim 30, wherein:

two straight rows of said storage shafts are located at spaced locations from, and opposite to, each other, wherein said dispensing unit is displaceable between said two rows of storage shafts.

32. A device in accordance with claim 30, wherein:

said dispensing unit is guided by rails or bars and driven by a drive motor arranged at one end of said row of storage shafts by a toothed belt.

33. A device in accordance with claim 32, further comprising:

a transfer station receiving said receiving tray, said dispensing unit being movable to said transfer station.

34. A device in accordance with claim 33, wherein:

said transfer station is arranged at another end of the row of storage shafts facing away from said drive motor.

35. A device in accordance with claim 33, wherein:

said transfer station has a packaging means for hygienically packaging said receiving tray filled with selected individually packaged products, wherein the individually packaged products are sorted in recesses of said receiving tray and are held in said recesses until end use.

36. A device in accordance with claim 18, wherein:

two rows of said storage shafts arranged one on top of another.

37. A device in accordance with claim 36, wherein:

said rows of storage shafts arranged one on top of another are connected to one another by a receiving tray elevator.

38. A device in accordance with claim 18, wherein:

a plurality of adjacent said storage shafts form a composite, one-piece storage module, wherein a row of said storage shafts or a ring of said storage shafts are composed of a plurality of said storage modules.

39. A device in accordance with claim 18, wherein:

an electronic control unit is provided which assumes both control functions for controlling individual assembly units and checking functions for correct selection of the individually packaged products in said receiving tray.

* * * * *